United States Patent [19]

Poulina et al.

[11] Patent Number: 4,813,975

[45] Date of Patent: Mar. 21, 1989

[54] FATTY ACID COMPOSITION SUITABLE FOR CANDLE PRESSING

[75] Inventors: Ramires R. Poulina; Abraham J. Meulenberg, both of Gouda, Netherlands

[73] Assignee: Unilever Patent Holdings B.V., Rotterdam, Netherlands

[21] Appl. No.: 100,173

[22] Filed: Sep. 23, 1987

[30] Foreign Application Priority Data

Sep. 25, 1986 [NL] Netherlands ..... 8602415
Jan. 28, 1987 [NL] Netherlands ..... 8700211

[51] Int. Cl.[4] ..... C10L 5/00; F23D 3/16
[52] U.S. Cl. ..... 44/7.5; 431/288
[58] Field of Search ..... 44/7.5; 431/288

[56] References Cited

U.S. PATENT DOCUMENTS 1,816,140 7/1931 Bain ..... 44/7.5
3,819,342 6/1974 Gunderman et al. ..... 44/7.5
4,682,947 7/1987 Luken, Jr. et al. ..... 431/288

FOREIGN PATENT DOCUMENTS 1424993 12/1965 France ..... 44/7.5
6500835 10/1965 Netherlands .
6817692 6/1969 Netherlands .
505197 5/1971 Switzerland ..... 44/7.5

OTHER PUBLICATIONS

Chem. Abstr. vol. 64 (1966) 8510e.
Derwent Abstract (40318s).

*Primary Examiner*—Carl F. Dees
*Attorney, Agent, or Firm*—Cushman, Darby & Cushman

[57] ABSTRACT

The invention provides a composition of matter, which is suitable for manufacturing candles by pressing/extruding, which is based on stearic/palmitic acid and also comprises:

0.2–10% (w.w) of a crystal modifier and optionally 0.5–15% (w.w) of another, as to carbon chain length adjacent, natural fatty acid and/or such fatty acid derivative. Preferably the stearic/palmitic acid is a mixture of stearic acid and palmitic acid in the weight range of 20–80:80–20.

The crystal modifier is usually of the ester type and is derived from a polyol with 2–4 hydroxyl groups and higher fatty acid and/or dimeric fatty acid.

11 Claims, No Drawings

FATTY ACID COMPOSITION SUITABLE FOR CANDLE PRESSING

The invention relates to a fatty acid composition, more in particular to a fatty acid composition suitable for candle manufacture by pressing. The manufacture of candles (usually called "stearic" candles) usually takes place by pouring technical stearic acid at around its solidification point into a mould. This requires craftsmanship and precise control of temperature, because otherwise the quality of the candle detoriates.

Paraffin candles, however, sometimes mixed with some stearic acid (up to 20% w.w.) are manufactured on a technical scale with quite different, simpler equipment, because paraffin has a such physical properties that it can easily be worked into candles by pressing or extruding.

The present invention provides a fatty acid composition, which is suitable for manufacturing candles by extruding or pressing so that the more simple equipment already in general use for extruding/pressing paraffin candles can also be used for the manufacture of stearic candles. The invention thus provides the possibility of combining the excellent quality of stearic candles with the convenient and easy manufacture of paraffin candles.

The fatty acid composition provided by the present invention usually contains stearic- and palmitic acid (technical, distilled, grade) in a weight ratio in the range between 20–80:80–20. More in particular such fatty acid mixtures of stearic—and palmitic acid are employed, which are about eutectic in their composition and contain within a few percent about 58 or about 27% of stearic acid, the remainder being palmitic acid.

The present invention provides a fatty acid composition suitable for candle manufacture by pressing, which contains at least one cyrstal modifier, and preferably also a (natural=even numbered) fatty acid, which has a chain length adjacent to that of the palmitic-/stearic acid base and which is a $C_{12}$–$C_{14}$ and/or $C_{20}$–$C_{22}$ fatty acid and/or a $C_{12}$–$C_{22}$ fatty acid.

The crystal modifier employed according to the present invention can be of the type disclosed in British specification (GB-A-)1.015.354 (Chemetron Corp.) and as is the case with the fatty acid component derivative it is present in an amount of 0.2–10, preferably between 0.5 and 6% by weight. There is a preference for employing a crystal modifier, which comprises an ester derived from a polyol and fatty acid and/or dimeric fatty acid. More preferred is a modifier in which groups derived from fatty acid and from dimeric fatty acid are present. Partial and complete esters can be used, but the former are preferred.

The polyol component of the crystal modifier can contain 2–5 carbon atoms and 2–4 hydroxyl groups. Examples are e.g. glycerol, neopentylglycol, trimethylolpropane, and pentaerythritol. Glycerol is preferred. Low molecular weight polyvinylalcohol fatty acid esters can also be employed for this purpose according to the present invention.

The fatty acid component of the crystal modifier usually contains 16–18 carbon atoms and the dimeric fatty acid 32–36 carbon atoms and of course two carboxylic groups. Sometimes the dimeric fatty acid also contains some trimeric fatty acid. The crystal modifier usually has a weight average molecular weight between 250 to 5000, preferably between 750 and 2500.

The other, optional, component, which is also used in accordance with the present invention in an amount of 0.5–15% (w.w) is a natural fatty acid, which is as to chain length adjacent to stearic/palmitic acid, therefore a $C_{14}$ and/or $C_{20}$ saturated monocarboxylic acid, which can be combined with a $C_{12}$ or $C_{22}$ fatty acid. Also suitable are $C_{12}$–$C_{22}$, fatty acid amides. Preferably a saturated amide such as stearamide and behenamide is used. Preferred are fatty acid derivatives containing 12–22 carbon atoms and erucamide and stearamide yield excellent results. The total amount of stearic/palmitic acid in the composition is between 75 and about 99% (w.w).

The fatty acid compositions according to the present invention proved to show such an improved elasticity that they could be shaped by pressing and yielded after pressing a hard candle with an undamaged surface (free from flaws and cracks), and could be subjected to the conventional, industrial finishing techniques such as polishing. The fatty acid composition according to the invention showed a favourable combination of yield properties and hardness.

The fatty acid composition according to the present invention can be used conveniently in a particulate form such as powder, flakes, pellets and extrudates and can be processed with good results in commercially available pressing/moulding equipment for the processing for paraffin candles such as candles for tea-warmers. This fatty acid composition, which preferably is a powder with an average particle size up to 1 mm, could also well be extruded to form a bar, which could subsequently be processed to candles. There was no need for a precise temperature control and losses were minimal.

By this novel process candles of prime quality can be obtained, which candles consisted wholly or partially of a fatty acid composition containing a crystal modifier and a fatty acid or derivative thereof having a chain length adjacent to that of palmitic/stearic fatty acid mixture as described above. Preferably the candle according to the present invention, with the exception of the wick material, consists entirely of the fatty acid composition according to the present invention.

The invention is now illustrated by the following examples:

EXAMPLE 1

A mixture consisting of:

90 parts by weight of stearic/palmitic acid/myristic acids in the weight ratio 32/64/4 w.w.;

5 parts by weight of crystal modifier prepared from 1 mole of glycerol, 2 moles of stearic acid and 0.5 mole of $C_{36}$ dimeric fatty acid; parts by weight of erucamide, were molten, stirred and flaked over a conventional scraped cooling drum. The solid material was then ground to a powder with an average particle size of 0.4 mm.

A duplex plodder of the type Mazzoni (tradename) M 100 was adjusted as follows:

temperature outer mantle: 25° C.
temperature nozzle: 65° C.
filter: 0.5 mm
temperature when leaving extruder: 39° C.
diameter of the nozzle: 15 mm The ground fatty acid composition was fed into the plodder and was worked on the machine into a compact candle string.

On an Instron (tradename) 1122 universal testing instrument subsequently the strength was determined by testing an appropriate sample. The value determined of 100N was close to that determined for an equivalent piece of stearic/palmitic (40/60) candle. The flow-properties, in particular the yield point however, were considerable improved when compared with those of usual palmitic/stearic acid (40/60) composition. When using an orifice plate with a 2 mm bore hole and a pressure of 20 bar the fatty acid composition according to the invention could be pressed through per minute in twice the weight amount of the conventional stearic/palmitic acid (40/60) mixture alone.

EXAMPLE 2

A mixture consisting of:

95 parts by weight of stearic/palmitic acid in the weight ratio of 60:40;

2.5 parts by weight of crystal modifier according to Example 1;

2.5 parts by weight of erucamide were molten at 70°-75° C. and sprayed with a semi-technical pelleting machine having a nozzle of 0.4 mm on a cooled rotating drum.

Using the beads so obtained pressings were effected on a commercially avaible pressing machine for paraffin candles. Cylinders were pressed of 50 mm diameter and a length of 60 to 70 mm. The final pressure rose to 20 to 22 MPa and each pressing took about 5 seconds. The raw candles so obtained were compact, had no cracks and were of good mechanical properties. When pressing no difficulties were experienced, which was in contrast when trying to press conventional palmitic/stearic acid mixtures.

EXAMPLES 3-8

Using the procedure described in Example 1, fatty acid compositions were prepared and tested. However the material was ground and sieved to an average particle size between 0.6 and 1.0 mm. The compositions and test results are tabulated below.

I claim:

1. A composition of matter, which is suitable for manufacturing candles by pressing and which is based on stearic/palmitic acid, which composition also comprises:

(1) 0.2-10% (w.w.) of a crystal modifier which is an ester derived from a polyol with 2-5 carbon atoms and 2-4 hydroxyl groups, and at least one member of the group selected from a fatty acid and a dimeric fatty acid, which ester has a weight average molecular weight between 250 and 5000, and optionally (2) 0.5-10% of (w.w.) of at least one member of the group selected from a fatty acid and a fatty acid derivative, wherein the carbon chain of said member differs in its length from the carbon chain of the stearic/palmitic acid by two carbons.

2. A composition according to claim 1 in which the stearic/palmitic acid is a mixture of stearic acid and palmitic acid in the weight range of 20-80:80-20.

3. A composition according to claim 1 in which the crystal modifier and the other fatty component are each present in an amount of 0.5-6% by weight.

4. A composition according to claim 1 in which the fatty acid of element (2) of claim 1 is a $C_{12-14}$ or $C_{20-22}$ fatty acid.

5. Composition according to claim 1 in which the fatty acid derivative is a $C_{12}$-$C_{22}$ fatty amide.

6. Composition according to claim 5 in which the amide is stearmide.

7. Composition according to claim 5 in which the amide is erucamide.

8. Process for the manufacture of candles in which the fatty acid composition according to claim 1 is converted into candles by extruding/pressing the particulate fatty acid composition.

9. Candle consisting of the fatty acid composition according to claim 1.

10. A composition according to claim 1 further comprising at least one member of the group selected from a $C_{12}$-$C_{22}$ fatty acid and fatty acid amide.

11. Candle comprising the fatty acid composition according to claim 1.

* * * * *

| Example | 1 | 2 | 3 | 4 | 5 | 6 | 7 | 8 |
|---|---|---|---|---|---|---|---|---|
| Composition (w/w %) | | | | | | | | |
| $C_{16}$ fatty acid | 57.6 | 60.8 | 57.6 | 60.8 | 55.7 | 57.6 | 57.6 | 57.6 |
| $C_{18}$ fatty acid | 28.8 | 30.4 | 28.8 | 30.4 | 27.8 | 28.8 | 28.8 | 28.8 |
| $C_{14}$ fatty acid | 3.6 | 3.8 | 8.6 | 3.8 | 12.5 | 6.1 | 7.35 | 11.1 |
| $C_{12}$ fatty acid | — | — | — | — | — | — | 1.25 | — |
| $C_{20}$ fatty acid | — | — | — | — | — | 2.5 | — | 2 |
| Crystal Modifier | 5.0 | 2.5 | 5 | 4 | 4 | 5 | 5 | 0.5 |
| Paraffin | — | — | — | — | — | — | — | — |
| Erucamide | 5.0 | 2.5 | — | — | — | — | — | 61.2 |
| Yield point (MPa) | — | 47.9 | 26.3 | 41.3 | 26.4 | 26.4 | 26.4 | 7.5 |
| Hardness (ASTM 1321-81) | 12 | 8 | 8 | 8 | 10 | 9 | 9 | 88 |
| Bursting strength (N) (disc 9 mm thickness; 5.3 cm diameter) | 100 | 98 | 92 | 92 | 92 | 101 | 84 | 84 |

Standard stearic acid for candles (64% palmitic, 32% stearic and 4% myristic acid) shows a yield point of 81.00 MPa, hardness of 6 and required a force for rupture of 9.8 N, whereas for standard tealight paraffin (containing 12.8% palmitic, 6.4% stearic and 0.8 myristic acid) these data were respectively 21.49 MPa, 13 and 9.2 N.